US010563608B2

(12) United States Patent
Graf

(10) Patent No.: US 10,563,608 B2
(45) Date of Patent: Feb. 18, 2020

(54) DELIVERY DEVICE FOR DELIVERING A MEDIUM AND FOR LIMITING A SYSTEM PRESSURE

(71) Applicant: Continental Automotive GmbH, Hannover (DE)

(72) Inventor: Rolf Graf, Glashuetten (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/539,012

(22) PCT Filed: Dec. 16, 2015

(86) PCT No.: PCT/EP2015/079931

§ 371 (c)(1),
(2) Date: Jun. 22, 2017

(87) PCT Pub. No.: WO2016/102260

PCT Pub. Date: Jun. 30, 2016

(65) Prior Publication Data

US 2017/0363034 A1 Dec. 21, 2017

(30) Foreign Application Priority Data

Dec. 23, 2014 (DE) ..... 10 2014 226 972

(51) Int. Cl.
*F02D 41/30* (2006.01)
*F02M 37/08* (2006.01)
(Continued)

(52) U.S. Cl.
CPC ..... *F02D 41/3082* (2013.01); *F02D 41/20* (2013.01); *F02D 41/22* (2013.01);
(Continued)

(58) Field of Classification Search
USPC ..... 123/357–359, 497–499; 701/102, 103, 701/112; 73/114.38, 114.41, 114.43
See application file for complete search history.

(56) References Cited

U.S. PATENT DOCUMENTS 4,728,264 A 3/1988 Tuckey
5,762,159 A * 6/1998 Matsuoka ..... B62D 5/065 180/417

(Continued)

FOREIGN PATENT DOCUMENTS

CN 102536772 7/2012
CN 102562384 7/2012

(Continued)

*Primary Examiner* — Kevin R Steckbauer
(74) *Attorney, Agent, or Firm* — Cozen O'Connor

(57) ABSTRACT

A delivery device for delivering a medium in a vehicle and for limiting a system pressure of the delivery device includes a vehicle pump, which is driven by an electric motor. The electric motor is controlled by a controller, the controller being configured to detect an actual rotational speed of the electric motor and an actual operating current of the electric motor. If the actual operating current of the electric motor exceeds a predefined operating current limit value, the controller is configured to generate a first signal relating to a system pressure being exceeded. The predefined operating current limit value is dependent on the actual rotational speed of the electric motor.

6 Claims, 2 Drawing Sheets

(51) Int. Cl.
*F02D 41/22* (2006.01)
*F02D 41/20* (2006.01)

(52) U.S. Cl.
CPC ..... *F02M 37/08* (2013.01); *F02D 2041/2058* (2013.01); *F02D 2041/224* (2013.01); *F02D 2200/0602* (2013.01); *F04B 2203/0201* (2013.01); *F04B 2203/0209* (2013.01); *F04B 2205/05* (2013.01)

(56) References Cited

U.S. PATENT DOCUMENTS 7,431,020 B2 * 10/2008 Ramamurthy ..... F02M 37/106 123/497
7,997,253 B2 * 8/2011 Serra ..... F02M 63/0235 123/456
8,527,176 B2 * 9/2013 Zimmermann ..... B60T 8/4022 188/137
8,932,026 B2 * 1/2015 Akita ..... F02D 41/3082 417/2
9,127,611 B2 * 9/2015 Graf ..... F02D 41/221
9,528,519 B2 * 12/2016 Sausner ..... F02D 41/221
2003/0230352 A1 * 12/2003 Hart ..... B67D 7/0476 141/59
2008/0127944 A1 * 6/2008 Ramamurthy ..... F02M 37/106 123/457
2009/0007885 A1 * 1/2009 Serra ..... F02M 63/0215 123/456
2011/0132328 A1 * 6/2011 Attwood ..... F02M 37/0023 123/456
2012/0156056 A1 * 6/2012 Akita ..... F04B 49/065 417/42
2012/0156057 A1 * 6/2012 Akita ..... F02D 41/3082 417/44.2
2012/0245819 A1 * 9/2012 Graf ..... F02D 41/221 701/99
2013/0158783 A1 * 6/2013 Zimmermann ..... B60T 8/4022 701/34.4
2013/0340721 A1 * 12/2013 Suda ..... F02D 41/221 123/496
2015/0275812 A1 10/2015 Mori et al.
2015/0330346 A1 * 11/2015 Tagawa ..... F02M 37/08 123/496
2016/0237944 A1 * 8/2016 Adelman ..... F02D 41/3082
2017/0276087 A1 * 9/2017 Behrendt ..... F02D 41/123
2017/0314548 A1 * 11/2017 Graf ..... F02M 37/08
2017/0321618 A1 * 11/2017 Jausel ..... F02M 37/22
2017/0335788 A1 * 11/2017 Behrendt ..... F02M 37/08
2017/0338758 A1 * 11/2017 Graf ..... F04D 13/06
2018/0017050 A1 * 1/2018 Graf ..... F04B 17/03
2018/0073498 A1 * 3/2018 Behrendt ..... F02D 41/3082
2018/0142642 A1 * 5/2018 Grime ..... F02D 41/3082

FOREIGN PATENT DOCUMENTS

DE 10 2008 041 126 A1 2/2010
DE 112013005000 7/2015
JP 2008014183 A * 1/2008 ..... Y02T 10/123
WO WO 2012/089400 7/2012

* cited by examiner

DELIVERY DEVICE FOR DELIVERING A MEDIUM AND FOR LIMITING A SYSTEM PRESSURE

CROSS-REFERENCE TO RELATED APPLICATIONS

This is a U.S. national stage of application Ho. PCT/EP2015/G79331, filed on 16 Dec. 2015, which claims priority to the German Application No. 10 2014 226 972.5 filed 23 Dec. 2014, the content of both incorporated herein by reference.

BACKGROUND OF THE INVENTION

1. Field of the Invention

The invention relates to a delivery device for delivering a medium in a vehicle and for limiting a system pressure of the delivery devices to a vehicle, to a method, to a program element and to a computer-readable medium.

2. Related Art

Normally, fuel systems of motor vehicles may have a mechanical pressure-limiting valve for pressure limitation, which pressure-limiting valve opens in the event of an exceedance of a certain fuel pressure and thus prevents a further pressure increase in the system. The pressure-limiting valve may be configured as a mechanical component, which may either be integrated in the fuel pump, or which may be added as a separate component to the system. The component normally does not intervene during normal operation, but can increase the system costs and the likelihood of failure of the system.

Furthermore, it is possible, for cost reasons, for modern motor vehicles not to be equipped with a sensor for measuring a fuel pressure. It may therefore be the case that, for the engine controller, it is not directly possible, by measurement of the fuel pressure and of the values preset to the electronic pump controller, to infer the state of the fuel supply system and possibly limit an overpressure by suitable measures. Furthermore, in modern vehicles, the problem may exist that the fuel system has to be pressurized very rapidly in order to perform a rapid start of the internal combustion engine in order that, from practically the very first moment, the exhaust-gas values correspondingly comply with the legal requirements. The typically demanded values for the pressure increase times in such systems may range from 100 ms to 300 ms for a pressure increase from a system pressure 0 to a system pressure of approximately 4-6 bar. The demanded pressure increase times may make it necessary for the pump stage to be operated with acceleration ramps of maximum, angular acceleration at the current and torque limits of the driving electric motor, which can lead to overshoots of the pressure in the delivered medium. It may furthermore be the case that, in certain vehicles, at the initial moment of starting, the engine controller cannot yet provide a suitable control signal because its initialization has not yet been fully completed. Here, it is possible for a high fixed value for the pump rotational speed to be output, which can then likewise lead to very high system pressures in the case of a small extraction quantity.

SUMMARY OF THE INVENTION

It can be considered to be an object of the invention to increase the reliability of delivery devices for vehicles.

A first aspect of the invention relates to a delivery device for delivering a medium in a vehicle and for limiting a system pressure of the delivery device, which delivery device has a vehicle pump, an electric motor for driving the vehicle pump, and a controller configured to control the electric motor. Here, the controller is configured to ascertain a present rotational speed of the electric motor and a present operating current of the electric motor. Furthermore, the controller is configured to generate a first signal relating to a system pressure exceedance of the delivery device if the present operating current of the electric motor exceeds a predefined operating current threshold value, wherein the predefined operating current threshold value is dependent on the present rotational speed of the electric motor.

In other words, through intelligent evaluation of the operating current and of the rotational speed of the electric motor, the system pressure of the delivery device can be limited without a pressure-limiting valve. The controller according to the invention can thus replace the pressure-limiting valve. Since the delivery device can thus dispense with a mechanical component, which may exhibit a certain likelihood of failure, it is possible for the reliability of the delivery device to be increased overall. Furthermore, through regulation of the electric motor, the system pressure can be limited more rapidly and independently of preset values, because a direct relationship exists between pressure and operating current. Furthermore, mechanical decelerations, which can arise, inter alia, owing to pressure waves in hydraulic lines, can be avoided. Overshoots of the system pressure and/or pressure peaks can also be more rapidly limited.

Here, the expression "delivery device" may be understood in a broad sense. That is to say, those components of the delivery device that are mentioned in detail need not imperatively form one collective structural unit. For example, the vehicle pump, the electric motor for driving the vehicle pump and the controller may describe different, mutually separate structural units. For example, the controller that controls the electric motor may be a part of an engine controller. It is furthermore also possible for different components of the delivery device to together form a structural unit. For example, the vehicle pump and the electric motor for driving the vehicle pump may together form a structural unit. Furthermore, the controller that controls the electric motor may also form a structural unit together with the vehicle pump and the electric motor.

The vehicle pump may, for example, be a fuel pump configured to deliver fuel for an internal combustion engine of a vehicle. In conjunction with the present invention, the vehicle pump may be realized in various forms. For example, the vehicle pump may be a gerotor pump. Furthermore, the vehicle pump may be a screw pump or roller cell pump. Other embodiments of the vehicle pump are however also possible. Here, the vehicle pump may be understood to be a pump that can be used in the automotive sector. The electric motor may, for the delivery of the medium, be connected to the vehicle pump such that the electric motor drives the pump. Here, the electric motor may be a mechanically commutated or DC motor or an electrically commutated or EC motor. Here, the present invention may be applied to both types of electric motors and also to other electric motors.

Depending on the electric motor, numerous possibilities may exist with regard to the manner in which the controller can ascertain the present rotational speed of the electric motor. For example, electrically commutated electric motors may be regulated in terms of rotational speed. It is thus possible, in the case of electrically commutated electric motors, for the controller to receive the rotational speed of the electric motor from a regulator of the electric motor. Furthermore, the controller that controls the electric motor and the regulator of the electric motor may be the same unit. Furthermore, a separate ascertainment of the rotational speed of the electric motor may also be performed. For example, in the case of mechanically commutated electric motors, the rotational speed of the electric motor may be ascertained by monitoring of current ripples of the electric motor by the controller. The operating current of the electric motor may be understood to mean the current consumed for the drive of the electric motor. For example, this may be understood to mean the current that flows through the windings of the electric motor. In other words, the operating current of the electric motor may be understood to mean a phase current of the electric motor in the case of EC motors. An effective value or pseudo effective value of the operating current with suitable integration time may be used as the present operating current. For example, for this purpose, integration may be performed over one electrical period or one mechanical rotation. In the case of DC motors, a floating mean value may be used as the present operating current. Here, in the context of the present invention, "present" may be understood to mean that an operating current at the time of the ascertainment is used. This does not rule out the possibility of the operating current being a mean value or an effective value or pseudo effective value that may be defined over a certain time period.

In the context of the present invention, a present variable may be understood to mean an instantaneous variable, wherein this does not rule out the possibility of the variable being a variable determined in a particular time period. The variable may, for example, be an operating current, a rotational speed, a system pressure or some other variable. In other words, the feature "present" or "instantaneous" does not need to be interpreted narrowly in this context.

The controller may thus be configured to compare the ascertained present operating current of the electric motor with a predefined operating current threshold value. The operating current threshold value may, for example, be stored in a corresponding characteristic map of the controller. Here, the predefined operating current threshold value may also be understood to mean a predetermined operating current threshold value. The operating current threshold value may, for example, be permanently stored in the controller or in a memory that can be accessed by the controller. Furthermore, the operating current threshold value is also dependent on the present rotational speed of the electric motor. In other words, the predefined operating current threshold value may be an operating current threshold value curve. That is to say, the operating current threshold value may comprise multiple points of an operating current threshold value curve. It is thus possible for the predefined operating current threshold value to differ for different rotational speeds of the electric motor. Furthermore, the operating current threshold value may also be dependent on other parameters, for example on the voltage of the electric motor.

A functional relationship may exist between the system pressure of the delivery device, the operating current of the electric motor and the rotational speed of the electric motor. The system pressure may in this case denote for example the pressure of the medium in the vehicle pump and/or in feed lines or discharge lines of the vehicle pump. The predefined operating current threshold value, which is dependent on the present rotational speed of the electric motor, may correspond, on the basis of this functional relationship, to a system pressure threshold value. In other words, the curve described by the operating current threshold value, which is dependent on the present rotational speed of the electric motor, may describe a line of constant pressure or an isobar. In other words, the operating current threshold value may define a system pressure threshold value. Furthermore, the controller may be configured to compare the present operating current with the predefined operating current threshold value for the present rotational speed. For example, the controller may be configured to read out a characteristic map in which the operating current threshold value for the present rotational speed is stored and to compare the value with the present operating current. If the present operating current exceeds the present operating current threshold value, then the controller generates the first signal relating to the operating current exceedance. The first signal may, for example, be transmitted to a regulation unit of the electric motor and/or to an engine controller. For example, the first signal may lead to the electric motor being regulated such that the system pressure in the delivery device falls again. In this way, through the monitoring of the operating current and of the rotational speed of the electric motor, the system pressure of the pump can be monitored and controlled.

Here, it does not have to be necessary for the controller to initially calculate a system pressure in order to identify a system pressure exceedance. Furthermore, the controller may use further parameters, such as, for example, the temperature of the fuel, in order to determine a system pressure exceedance.

In an exemplary embodiment of the invention, the controller is configured to, on the basis of a functional relationship between the system pressure of the delivery device, the operating current of the electric motor and the rotational speed of the electric motor, calculate a present system pressure of the delivery device as a function of the present rotational speed and the present operating current of the electric motor. Furthermore, the controller is configured to generate the first signal relating to the system pressure exceedance of the delivery device if the calculated present system pressure of the delivery device exceeds a predefined system pressure threshold value.

The functional relationship may, for example, be understood to mean a formula by which the system pressure of the delivery device can be calculated as a function of the operating current of the electric motor and the rotational speed of the electric motor. The formula may, for example, be stored in the controller or in a memory that can be accessed by the controller. Furthermore, the functional relationship may also be defined in the form of a curve or in the form of multiple points. For example, a multiplicity of points of a system pressure threshold value curve, which describe a curve according to the functional relationship, may be stored in the controller and/or in the memory.

In this way, the controller can ascertain the system pressure that prevails in the delivery device. Furthermore, the controller may be configured with regard to the system pressure at which the first signal relating to the system pressure exceedance of the delivery device is generated. For example, the controller may also receive a new or changed system pressure threshold value, in the event of an exceedance of which the first signal should be generated, from another unit.

Typically, system pressures or working pressures for modern fuel systems stay lie in a range from approximately 2 to 7 bar. The system pressure threshold value may lie in a range from 5 to 8 bar. The critical system pressure threshold value may lie in a range from 7 to 8 or in a range from 7 to 9 bar. Here, the threshold values may be system-dependent, for example dependent on the mechanical load on the lines. The threshold values may therefore also have other values.

In a further exemplary embodiment of the invention, in the controller of the delivery device, there is stored a pump-specific profile of the operating current as a function of the rotational speed at a given pressure. In other words, a curve of constant pressure or an isobar may be stored in the controller. Furthermore, in the controller, there may be stored multiple pump-specific profiles of the operating current as a function of the rotational speed for different pressures.

In this way, the controller can ascertain whether the ascertained combination of present operating current and present rotational speed is positioned above, below or on the curve of the pump-specific profile of the operating current. The controller can thus easily ascertain whether the system pressure threshold value is exceeded or undershot.

In a further exemplary embodiment of the invention, the controller is configured to limit or reduce the present operating current of the electric motor and/or the present rotational speed of the electric motor if the controller generates the first signal relating to the system pressure exceedance of the delivery device.

In other words, the controller may be configured to adapt the operation of the electric motor such that the system pressure of the delivery device is limited or reduced. This may also be understood to mean that the controller transmits a signal for limiting or reducing the operating current and/or the rotational speed to a regulator of the electric motor. The regulator can then limit or reduce the operating current and/or the rotational speed. In this way, the controller can counteract the system pressure exceedance of the delivery device and actuate the electric motor such that the system pressure lies below the predefined system pressure threshold value again.

In a further exemplary embodiment of the invention, the controller is configured to generate a second signal relating to a critical system pressure exceedance of the delivery device if the calculated present system pressure of the delivery device exceeds a predefined critical system pressure threshold value. Furthermore, the controller is configured to deactivate the delivery device if the controller generates the second signal relating to the critical system pressure exceedance of the delivery device and the system pressure of the delivery device exceeds the critical system pressure threshold value during a predefined time period.

In other words, a second system pressure threshold value, specifically the critical system pressure threshold value, may be stored in the controller or in a memory that can be accessed by the controller. The critical system pressure threshold value may, in this case, be higher than the system pressure threshold value. For example, a rapid limitation of the system pressure of the delivery device may be necessary in the event of an exceedance of the critical system pressure threshold value. If the critical system pressure threshold value is not undershot during the predefined time period, the controller may be configured to deactivate the delivery device. In this way, damage to the delivery device or to other components resulting from an excessively long exceedance of the critical system pressure threshold value can be prevented. In other words, the controller may be configured to perform an emergency shutdown of the delivery device if the critical system pressure threshold value is exceeded for an excessively long time. Here, the feature "excessively long" may mean that the exceedance of the critical system pressure threshold value lasts for longer than the predefined time period.

A further aspect of the invention relates to a vehicle having a delivery device described in the context of the present invention, wherein the vehicle pump of the delivery device is a fuel pump for delivering fuel for an internal combustion engine of the vehicle.

The vehicle may, for example, be a motor vehicle or a heavy goods motor vehicle driven by the internal combustion engine. Furthermore, the vehicle may also be equipped with a hybrid drive. Furthermore, the features and advantages mentioned in conjunction with the delivery device are also applicable to the vehicle. Furthermore, the vehicle may also have been retrofitted with a controller that controls the electric motor of the delivery device in accordance with the invention.

A further aspect of the invention relates to a method for delivering a medium and for limiting a system pressure of a delivery device that has a vehicle pump driven by an electric motor. Here, the method monitors a present rotational speed and a present operating current of the electric motor. The method furthermore generates a first signal relating to a system pressure exceedance of the delivery device if the present operating current of the electric motor exceeds a predefined operating current threshold value. Here, the predefined operating current threshold value is dependent on the present rotational speed of the electric motor.

Here, the steps of the method may be performed in different sequences and/or in parallel. The method may furthermore be carried out by a controller of a delivery device described in the context of this invention. Thus, the features mentioned in conjunction with the described delivery device are also applicable to methods described above and below.

In an exemplary embodiment of the invention, the method furthermore calculates a present system pressure of the delivery device as a function of the present rotational speed and the present operating current of the electric motor on the basis of a functional relationship between the system pressure of the delivery device, the operating current of the electric motor and the rotational speed of the electric motor. The method furthermore comprises generating the first signal relating to the system pressure exceedance of the delivery device if the calculated present system pressure of the vehicle pump exceeds a predefined system pressure threshold value.

A further aspect of the invention relates to a program element which, when executed on a processor, commands the processor to carry out a method described in the context of the present invention.

Here, the program element may be loaded onto a controller of a delivery device that carries out the steps of the method. The program element may furthermore be a part of a computer program. Furthermore, the program element may also itself be an independent computer program. For example, the program element may, as an update, render an already existing computer program capable of carrying out the method according to the invention. Since the program element is configured to command the processor to carry out a method described in the context of this invention, the advantages and features mentioned in conjunction with the method also apply to the program element.

A further aspect of the invention relates to a computer-readable medium on which there is stored a program element which, when executed on a processor, commands the processor to carry out a method described in the context of the present invention.

Here, the computer-readable medium may be regarded as being a memory medium, for example a USB stick, a CD, a DVD, a hard disk or some other memory medium. Furthermore, the computer-readable medium may also be configured as a microchip which renders a controller capable of carrying out the method according to the invention.

The described embodiments relate equally to a delivery device, a vehicle, a method, a program element and a computer-readable medium, even though individual embodiments have been described with regard only to the delivery device, the vehicle, the method, the program element or the computer-readable medium. Synergistic effects may arise from various combinations of the embodiments, even if these are not described below.

Further features, advantages and possible uses of the invention will emerge from the following description of the exemplary embodiments and of the figures. Here, all of the features described and/or illustrated in the figures, individually and in any desired combination, form the subject matter of the invention, even independently of their amalgamation in the individual claims or in the back-references thereof.

DETAILED DESCRIPTION OF THE PRESENTLY PREFERRED EMBODIMENTS

The figures are illustrated schematically and not to scale.

Figure 1:
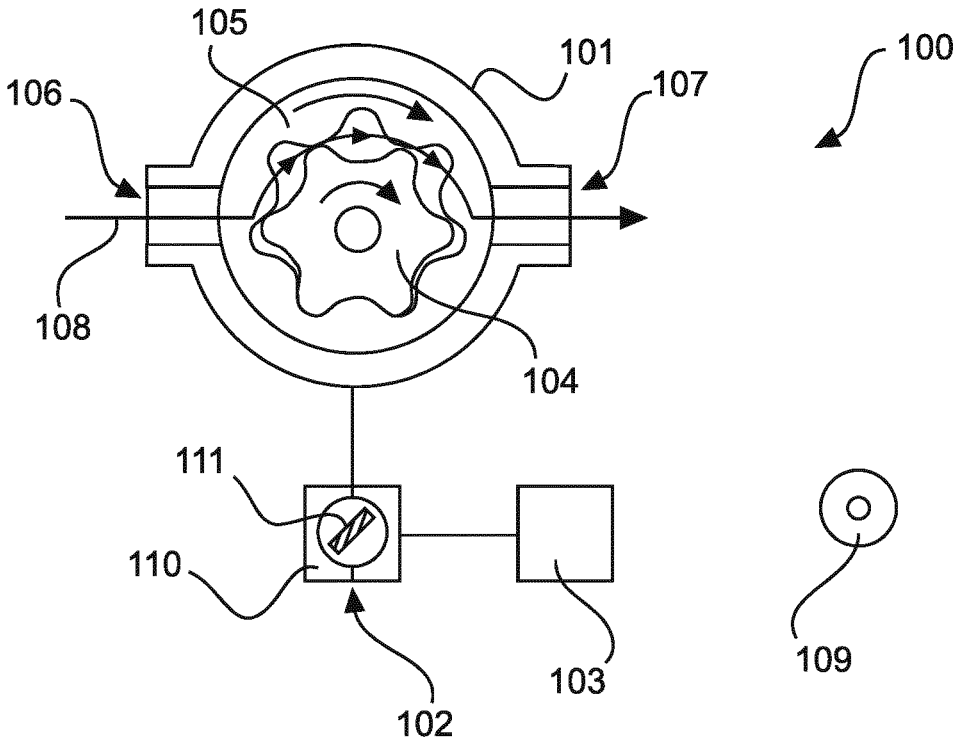
FIG. 1 shows a delivery device according to an exemplary embodiment of the invention.

FIG. 1 shows a delivery device 100 for delivering a medium in a vehicle and for limiting a system pressure of the delivery device. The delivery device has a vehicle pump 101, an electric motor 102 for driving the vehicle pump 101, and a controller 103 for controlling the electric motor 102, which electric motor comprises a stator 110 and a rotor 111. The controller 103 is configured to determine a present rotational speed of the electric motor 102 and a present operating current of the electric motor 102. Furthermore, the controller is configured to generate a first signal relating to a system pressure exceedance of the delivery device 100 if the present operating current of the electric motor 102 exceeds a predefined operating current threshold value, wherein the predefined operating current threshold value is dependent on the present rotational speed of the electric motor 102. In this exemplary embodiment, the vehicle pump 101 is a gerotor pump or a toothed-ring pump. Here, the driving toothed gear 104 runs eccentrically in the internal toothing 105 of the vehicle pump 101. The toothed gear 104 is driven by the electric motor 102. As a result of the rotation of the toothed gear 104, the medium is conveyed between the tooth spaces, whereby the medium is transported from an inlet 106 of the pump 101 to an outlet 107 of the pump 101 in the arrow direction 108. Here, the gerotor pump is merely an example and should not be regarded as restrictive. The invention may be realized for numerous different pump types.

In a further exemplary embodiment illustrated on the basis of FIG. 1, the controller 103 is configured to carry out a method for limiting the system pressure of the vehicle pump 101. Here, the method includes ascertaining the rotational speed of the vehicle pump 101. Here, if the electric motor 102 of the vehicle pump 101 is an electrically commutated electric motor, the rotational speed may be a known value, because electrically commutated electric motors are typically regulated in terms of rotational speed. In the case of mechanically commutated electric motors, it is possible for separate ascertainment of the rotational speed to be performed on the basis of current ripples, because, in hitherto existing systems, there is typically no need for rotational speed regulation to be implemented. Furthermore, the method comprises ascertaining the phase current of the electric motor 102. Furthermore, according to the method, a value that represents the rotational speed of the vehicle pump 101 and a value that represents the phase current of the vehicle pump 101 are fed to an evaluation unit. The evaluation unit may, for example, be a part of the controller 103. Furthermore, the evaluation unit may also be a further component of the delivery device 100, which, for the sake of clarity, is not illustrated in FIG. 1. The method furthermore comprises ascertaining, in the evaluation unit, the present pressure generated by the fuel pump 101. Furthermore, in the method, the present pressure is compared with a first pressure threshold value, and a signal is generated in the event of an exceedance of the first pressure threshold value. The first pressure threshold value may correspond to the operating pressure threshold value.

Furthermore, the controller 103 may be configured to implement further measures upon the generation of the signal in the event of exceedance of the first pressure threshold value. Here, in typical normal operation, the controller may regulate the system pressure to a certain preset value by virtue of the present operating current of the electric motor 102 being regulated to a rotational-speed-dependent current value stored in a characteristic map. Here, a pressure setpoint value, which it is sought to attain through regulation of the operating current, may be communicated to the controller 103 from a superordinate controller of the internal combustion engine. Furthermore, the controller may have a typical behavior pattern in the event of fault operation. For example, such a behavior pattern may be invoked if fuel is no longer being extracted and, in the presence of very small extraction quantities, the demanded first pressure threshold value can no longer be adhered to, for example because a minimum rotational speed cannot be undershot. If necessary, the controller 103 may attempt to limit the system pressure of the vehicle pump 101 to a certain value below the first pressure threshold value by limiting the current to a rotational-speed-dependent value corresponding to a characteristic map. Furthermore, it is also possible for the rotational speed of the electric motor 102 or a combination of rotational speed and operating current to be limited. In the event of an exceedance of a second pressure threshold value, the controller can generate a second signal. The second pressure threshold value may, for example, correspond to the critical system pressure threshold value. The controller may attempt to reduce the system pressure of the vehicle pump 101 to a certain value below the second pressure threshold value by limiting the current to a rotational-speed-dependent value corresponding to a characteristic map, or by limiting the rotational speed, or by a combination of both measures. Furthermore, the controller may also be configured to directly shut down the delivery device 100 and/or the pump 101 if it has not been possible for a certain length of time to limit the second pressure threshold value. This serves for system protection, in order that, for example, relatively severe damage can be prevented. Furthermore, the controller may also be configured to generate a warning message, which is transmitted for example to the engine controller, to the effect that the pump has been deactivated. The engine controller can then implement corresponding measures. If necessary, the controller 103 can trigger a restart of the delivery device 100, in the case of which, furthermore, an active control signal with the information "pump active" or with a valid pressure or rotational speed preset value is defined.

Furthermore, FIG. 1 illustrates a non-transitory computer-readable medium 109 on which, for example, a program for carry out the method, which is carried out by the controller 103, is stored. Furthermore, a functional relationship between operating current of the electric motor 102, rotational speed of the electric motor 102 and system pressure of the vehicle pump 101 may also be stored on the computer-readable medium.

Figure 2:
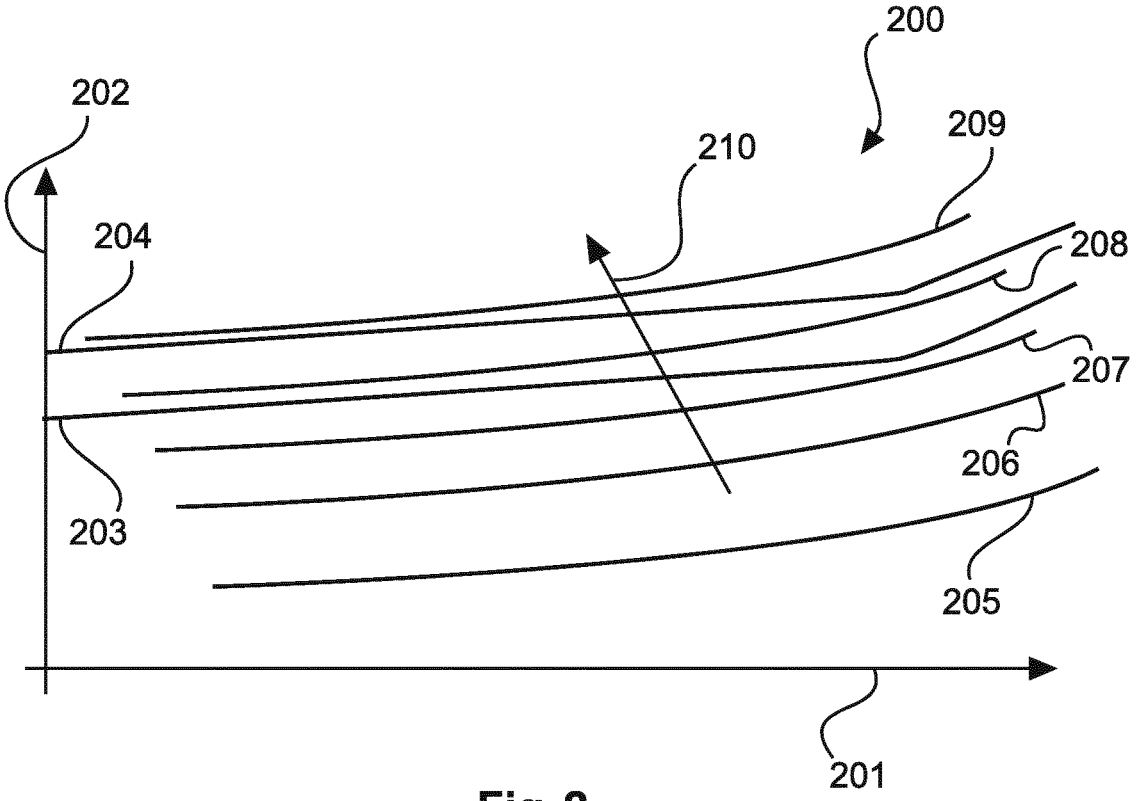
FIG. 2 shows a diagram according to an exemplary embodiment of the invention.

FIG. 2 illustrates a diagram according to an exemplary embodiment of the invention. The diagram comprises a first axis 201, which represents the rotational speed of the electric motor, and a second axis 202, which represents the operating current or the energy consumption of the electric motor 102. The first axis 201 may alternatively also denote the pump voltage. It may, for example, be the case that, in mechanically commutated electric motors, direct determination of the rotational speed is not possible. Here, the units in FIG. 2 are not specified. For example, the unit of the axis 201 is revolutions per minute, and the unit of the axis 202 is amperes. Furthermore, in the diagram, various curves 205, 206, 207, 208 and 209 are illustrated, which represent the current consumption of the electric motor as a function of the rotational speed. Here, the curve 205 corresponds to a pump-specific profile of the operating current for different rotational speeds in the presence of a constant system pressure of the vehicle pump P0. The curve 206 shows the pump-specific profile of the operating current in the presence of a constant pressure P1, the curve 207 shows the profile in the presence of a constant pressure P2, the curve 208 shows the profile in the presence of a constant pressure P3, and the curve 203 shows the profile in the presence of a constant pressure P4. Here, the pressures P0 to P4 are designated in an increasing sequence, that is to say the pressure P0 is lower than the pressure P1, the pressure P1 is lower than the pressure P2, the pressure P2 is lower than the pressure P3, and the pressure P3 is lower than the pressure P4, as is also illustrated by the arrow 210. System pressure threshold value curves 203 and 204 are also illustrated in FIG. 2. Thus, in FIG. 2, it can be seen that the curves 204 and 203 are dependent on the rotational speed illustrated on the axis 201. Here, the curve 203 corresponds to the predefined system pressure threshold value, and the curve 204 corresponds to the critical system pressure threshold value.

The controller 103 is configured to ascertain the rotational speed and the operating current of the electric motor 102. If the combination of the ascertained rotational speed and the ascertained operating current yields a point that lies below the curve 203 in the diagram 200, then the system pressure threshold value is not exceeded, and if the point defined by ascertained rotational speed and ascertained operating current lies between the curves 203 and 204, then the system pressure threshold value is exceeded and the critical system pressure threshold value is undershot, such that the controller 103 generates the first signal. If the point resulting from ascertained rotational speed and ascertained operating current is arranged above the curve 204, the system pressure threshold value and the critical system pressure threshold value are exceeded, such that the second signal is also generated. The system pressure threshold values or system pressure threshold value curves 203 and 204 may be stored in the controller 103. It is furthermore also possible for only one of the system pressure threshold value curves 203 or 204 to be stored in the controller 103. Here, it is also possible for data or points that define the system pressure threshold values or system pressure threshold value curves 203 and 204 to be stored in the controller 103.

Figure 3:
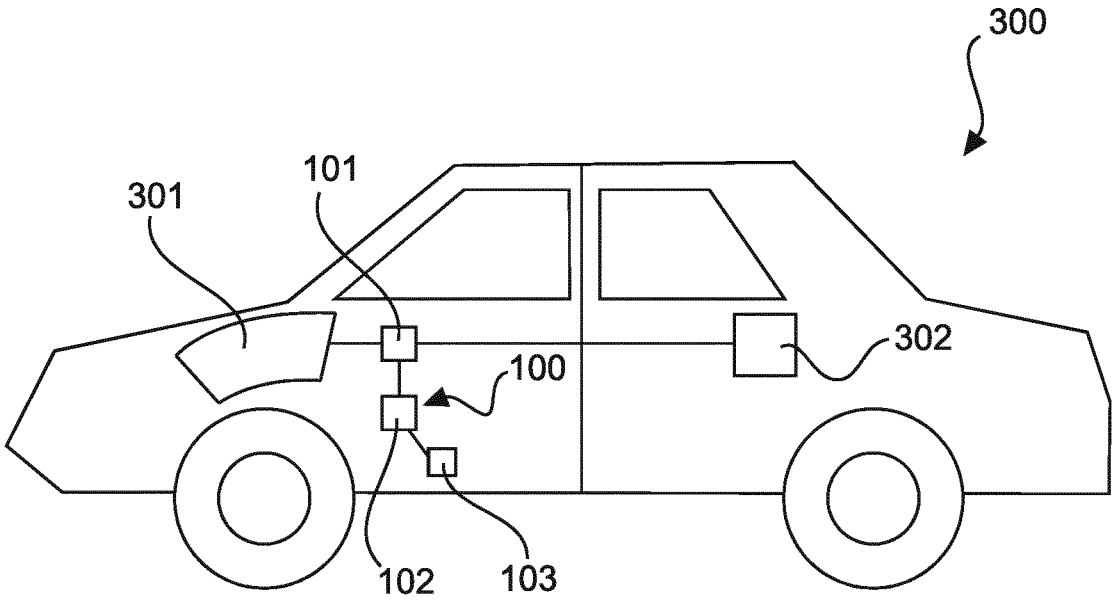
FIG. 3 shows a vehicle according to an exemplary embodiment of the invention.

FIG. 3 illustrates a vehicle 300 according to an exemplary embodiment of the invention. The vehicle has an internal combustion, engine 301, a fuel tank 302 and a delivery device 100, which is described in the context off the present invention and which supplies fuel from the fuel tank 302 to the internal combustion engine 301. The delivery device 100 comprises a pump 101, an electric motor 102 and a controller 103. Here, the controller may, for example, be part of the engine controller or may also have been retrofitted in order to improve the reliability of the delivery device 100.

Figure 4:
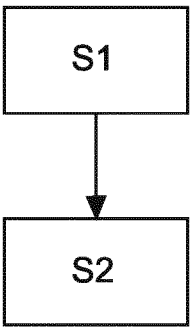
FIG. 4 shows a flow diagram of a method according to an exemplary embodiment of the invention.

FIG. 4 illustrates a flow diagram of a method for delivering a medium and for limiting a system pressure of a delivery device that has a vehicle pump driven by an electric motor. Here, the method comprises monitoring a present rotational speed and a present operating current of the electric motor (S1), and generating a first signal relating to a system pressure exceedance of the delivery device if the present operating current of the electric motor exceeds a predefined operating current threshold value (S2). Here, the predefined operating current threshold value is dependent on the present rotational speed of the electric motor.

It is additionally pointed out that the expressions "comprising" or "having" do not exclude other elements, and the expressions "a" or "an" do not rule out a multiplicity. It is also pointed out that features that have been described with reference to one of the above exemplary embodiments or embodiments may also be used in combination with other features of other above-described exemplary embodiments or embodiments. Reference designations in the claims are not to be regarded as being restrictive.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A delivery device for delivering a medium in a vehicle and for limiting a system pressure of the delivery device, the delivery device comprising:

a vehicle pump;

an electric motor configured to drive the vehicle pump; and a controller configured to control the electric motor, wherein:

the controller is configured to ascertain a present rotational speed of the electric motor and a present operating current of the electric motor, the controller is configured to, on the basis of a functional relationship between the system pressure of the delivery device, the operating current of the electric motor and the rotational speed of the electric motor, calculate a present system pressure of the delivery device as a function of the present rotational speed and the present operating current of the electric motor, the controller is configured to generate a first signal if the relationship between the ascertained present operating current of the electric motor and the ascertained present rotational speed indicates that the present system pressure exceeds a predefined operating system pressure threshold value but falls below a predefined critical system pressure threshold value, the controller is configured to limit or reduce the present operating current of the electric motor and/or the present rotational speed of the electric motor if the controller generates the first signal, the controller is configured to generate a second signal if the calculated present system pressure of the delivery device exceeds the predefined critical system pressure threshold value, and the controller is configured to, in response to the second signal, attempt, for a predetermined length of time, to reduce the present system pressure to a certain value below the predefined critical system pressure without deactivating the delivery device and, only in the case that is has not been possible for the controller to reduce the present system pressure to below the predefined critical system pressure threshold value within the predefined period of time, then, after expiration of the predetermined period of time, deactivate the delivery device.

2. The delivery device as claimed in claim 1, wherein in the controller there is stored a pump-specific profile of the operating current as a function of the rotational speed at a given pressure.

3. A vehicle (300) having a delivery device (100) as claimed in claim 1, wherein the vehicle pump is a fuel pump configured to deliver fuel for an internal combustion engine of the vehicle.

4. The delivery device as claimed in claim 1, wherein the delivery device is devoid of a pressure limiting valve.

5. The delivery device as claimed in claim 1, wherein the predefined operating system pressure threshold value is based on an operating current threshold value curve.

6. The delivery device as claimed in claim 1, wherein the vehicle pump is a fuel pump configured to deliver fuel, and the controller is configured to determine a system pressure exceedance based on a temperature of the fuel.

* * * * *